US006615531B1

(12) United States Patent
Holmberg

(10) Patent No.: US 6,615,531 B1
(45) Date of Patent: Sep. 9, 2003

(54) RANGE FINDER

(76) Inventor: Larry Holmberg, P.O. Box 1199, Hayward, WI (US) 54843

( * ) Notice: Subject to any disclaimer, the term of this patent is extended or adjusted under 35 U.S.C. 154(b) by 0 days.

(21) Appl. No.: 10/090,333

(22) Filed: Mar. 4, 2002

(51) Int. Cl.[7] ..... F41A 15/00

(52) U.S. Cl. ..... 42/142; 42/111; 42/114; 89/41.06; 33/506; 356/3; 356/5.01

(58) Field of Search ..... 42/142, 111, 114, 42/115; 89/41.17, 41.06; 33/506; 356/3, 21, 5.01

(56) References Cited

U.S. PATENT DOCUMENTS

| | | | | | |
|---|---|---|---|---|---|
| 2,101,479 | A | | 12/1937 | Schenk | 240/6.41 |
| 3,684,376 | A | | 8/1972 | Lessard | 356/21 |
| 3,782,822 | A | | 1/1974 | Spence | 356/21 |
| 4,531,052 | A | | 7/1985 | Moore | 235/404 |
| 4,617,741 | A | * | 10/1986 | Bordeaux et al. | 33/228 |
| 4,777,352 | A | | 10/1988 | Moore | 235/404 |
| 4,835,621 | A | | 5/1989 | Black | 358/335 |
| 4,939,863 | A | | 7/1990 | Alexander et al. | 42/103 |
| 5,026,158 | A | * | 6/1991 | Golubic | 356/252 |
| 5,373,657 | A | | 12/1994 | Betz et al. | 42/106 |
| 6,070,355 | A | | 6/2000 | Day | 42/106 |
| 6,073,352 | A | * | 6/2000 | Zykan et al. | 33/265 |
| 6,154,971 | A | | 12/2000 | Perkins | 33/265 |
| 6,269,581 | B1 | * | 8/2001 | Groh | 42/122 |
| 6,331,887 | B1 | | 12/2001 | Shiraishi et al. | 356/3.03 |
| 6,397,483 | B1 | * | 6/2002 | Perkins | 33/265 |

* cited by examiner

*Primary Examiner*—J. Woodrow Eldred
(74) *Attorney, Agent, or Firm*—Fogg and Associates, LLC

(57) ABSTRACT

A range finder for hunting applications. In one embodiment, a range finder includes a cylindrical main housing, a range finder circuit, a display housing, a display and one or more brackets. The range finder circuit is contained in the main housing. The display housing is couple to a first side of the main housing. The display is received in the display housing and is in electrical communication with the range finding circuit. The one or brackets are selectively coupled to a second side of the main housing, wherein the second side of the main housing is opposite the first side of the main housing. In addition, the one or more brackets are adapted to couple the main housing to a portion of a hunting weapon.

48 Claims, 9 Drawing Sheets

RANGE FINDER

TECHNICAL FIELD

The present invention relates generally to range finders and in particular range finders for hunting applications.

BACKGROUND

Range finders can be a useful tool when hunting for game. A ranger finder conveys the distance to an object (game target). This information is helpful to a hunter because it allows a hunter to determine if the target is beyond the range of a firearm or bow. Knowing the distance to a target also aids the hunter in the placement of the sight of the firearm or bow. For example, if the target is a great distance from a firearm, a hunter can raise the sight of the firearm over the target a select distance to compensate for the trajectory of a projectile (bullet) fired from the firearm. The distance found by the range finder can aid the hunter in determining how much the sight should be raised over the target.

Traditional range finders can be disruptive in a hunting situation. The hunter must operate the hunting weapon and the range finder at the same time. Moreover, telescopes incorporating range finder circuits are generally heavy, bulky and expensive to purchase.

For the reasons stated above and for other reasons stated below which will become apparent to those skilled in the art upon reading and understanding the present specification, there is a need in the art for an inexpensive range finder that is non-disruptive to operate in a hunting situation.

SUMMARY

The above-mentioned problems with range finders and other problems are addressed by the present invention and will be understood by reading and studying the following specification.

In one embodiment, a range finder is disclosed. The range finder includes a cylindrical main housing, a range finder circuit, a display housing, a display and one or more brackets. The range finder circuit is contained in the main housing. The display housing is couple to a first side of the main housing. The display is received in the display housing and is in electrical communication with the range finding circuit. The one or brackets are selectively coupled to a second side of the main housing, wherein the second side of the main housing is opposite the first side of the main housing. In addition, the one or more brackets are adapted to couple the main housing to a portion of a hunting weapon.

In another embodiment another range finder is disclosed. This range finder comprises a circuit housing, a range finder circuit, a display housing, a display, a weather cover, a power supply, one or more flanges and a bracket for each flange. The circuit housing has a first side and a second side that is opposite the first side. The range finder circuit is used to perform range finding functions and is contained in the circuit housing. The display housing is coupled to extend from the first side of the circuit housing. The display is encased in the display housing and is used to display distances. The display is in electrical communication with the range finder control circuit. The weather cover has a first end that is adapted to be selectively coupled to a first end of the circuit housing to form a weatherproof seal. The weather cover also has a second enclosed end. The power supply is selectively housed in the weather cover. Moreover, when the power supply is housed in the weather cover and the weather cover is coupled to the circuit housing, the power supply is electrically coupled to supply power to the range finder circuit and the display. The one or more flanges extend from the second side of the circuit housing and each bracket is adapted to couple an associated flange to a weapon.

In yet another embodiment, another range finder is disclosed. This range finder comprises a circuit housing, a range finder circuit, a display housing, a display, a weather cover and a power supply. The circuit housing is generally cylindrical in shape and has first end with internal threads. The range finder circuit is used to perform range finding functions and is contained in the circuit housing. The display housing is coupled to extend from a select side of the circuit housing. The display is encased in the display housing to display distances. The display is electrically coupled to the range finder circuit to receive distance signals sent by the range finder circuit. The weather cover is cylindrical in shape and has a first end with external threads that terminate in a shoulder. The external threads of the weather cover are adapted to threadably engage the internal threads of the circuit housing. The weather cover further has a second enclosed end. The power supply is selectively housed in the weather cover, wherein when the power supply is housed in the weather cover and the weather cover is threadably coupled to the circuit housing, the power supply is electrically coupled to the range finder circuit and the display.

In still another embodiment, another range finder is disclosed. This range finder includes a main housing, a range finder circuit, a display and one or more brackets. The range finder circuit is contained in the main housing and is used to determine distances to objects. The display housing extends from the main housing. The display is encased in the display housing and is electrically coupled to the range finder circuit to display one or more indicia representative of distances determined by the range finder circuit. The one or more brackets are coupled to the range finder housing and are adapted to couple the range finder housing to a scope.

In another embodiment, a method of operating a range finder is disclosed. The method comprises, powering the range finder. Monitoring for an activation signal. When an activation signal is received, determining a distance to an object. Displaying the distance on a display. Monitoring the time from when the distance was first displayed on the display. When a select amount of time has past, clearing the display.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description of the preferred embodiments, reference is made to the accompanying drawings, which form a part hereof, and in which is shown by way of illustration specific prefer red embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Figure 1:
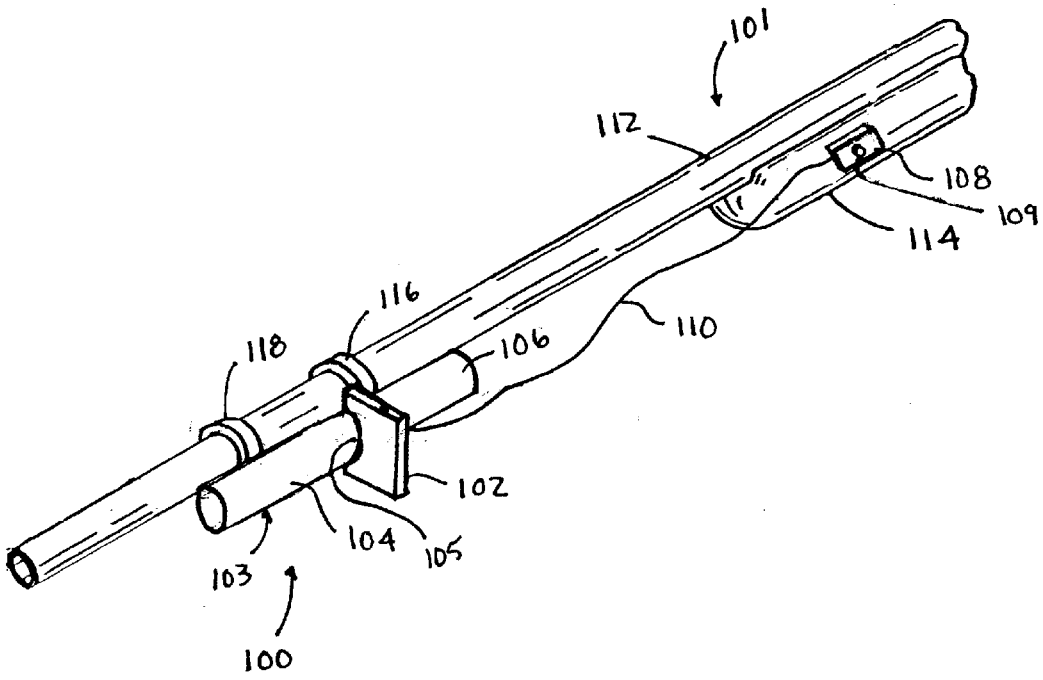
FIG. 1 is a side perspective view of one embodiment of the present invention coupled to a barrel of a firearm.

Embodiments of the present invention relate to range finder that is adapted to be mounted to a firearm. Referring to FIG. 1, a side perspective view of one embodiment of a range finder 100 coupled to a firearm 101 of the present invention is illustrated. As illustrated, the range finder 100 is coupled to the barrel 112 of the firearm 101 with a first bracket 116 and a second bracket 118. The range finder 100 of this embodiment is illustrated as having a cylindrical main housing 103 and a display housing 102 that extends from a mid portion 105 of the main housing 103. Main housing 103 includes a circuit housing 104 and a weather cover 106. Also illustrated in FIG. 1, is remote unit 108. Remote unit 108 is selectively coupled to the forearm 114 of the firearm by an adhesive, a loop and hook fastener or the like. The remote control unit 108 has an activation button 109. When the activation button 109 is depressed, the range finder 100 is activated. The remote control unit 108, of the embodiment of FIG. 1, is electrically coupled to the range finder by attaching cord 110. In another embodiment, the remote control unit 108 is in wireless communication with the range finder 100.

Figure 2:
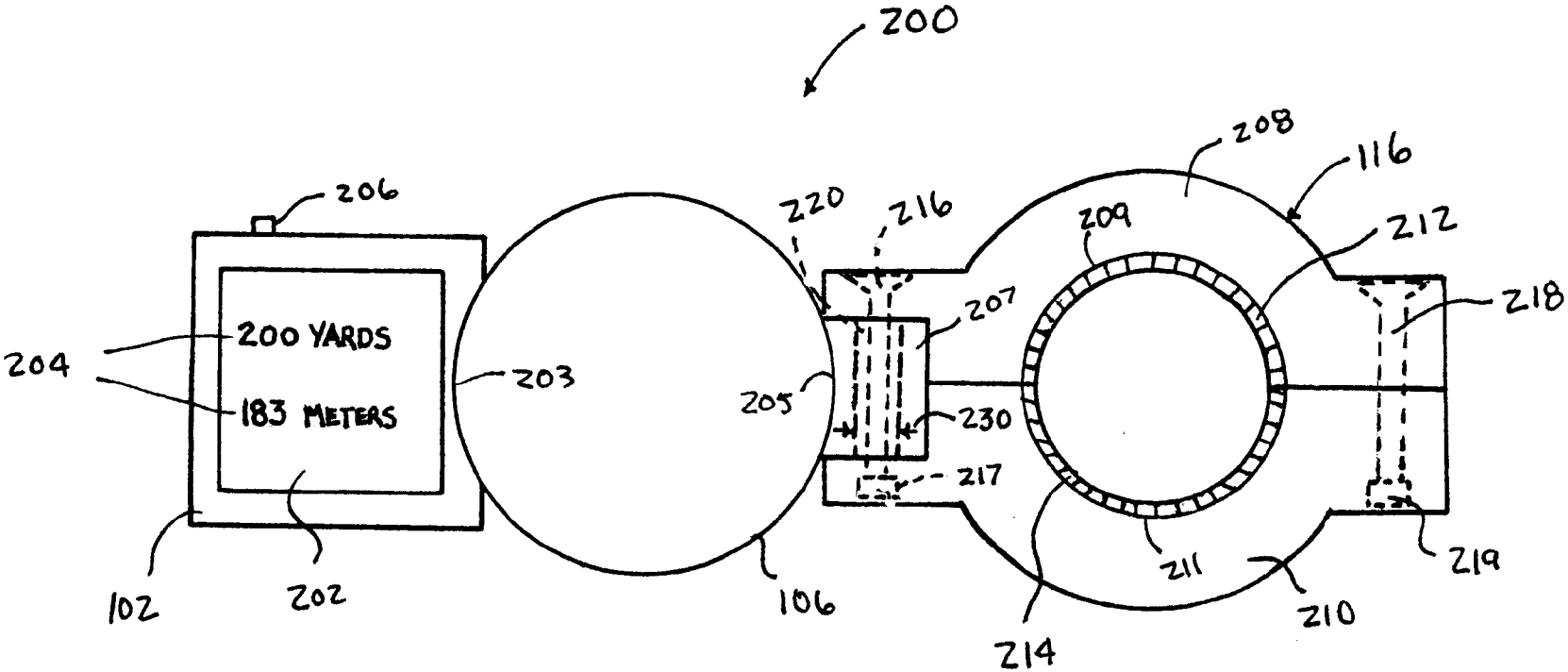
FIG. 2 is a rear view of one embodiment of the present invention.

A rear view of one embodiment of a range finder 200 of the present invention is illustrated in FIG. 2. As illustrated, a display 202 is encased in the display housing 102. The display may be a liquid crystal display or other type of display capable of conveying a message. When activated, the display 202 displays indicia 204 to convey the distance from the range finder 200 to an object it is pointed at. In the embodiment of FIG. 2, the indicia 204 conveys the distance in yards and meters. A brightness control 206 is mounted through the display housing 102 to control the brightness of the display 202.

Also illustrated in FIG. 2, is first bracket 116. As illustrated, the first bracket 116 includes a first bracket portion 208 and a second bracket portion 210. In this embodiment, the first bracket portion 208 fits over a barrel of a firearm and the second bracket portion 210 fits under the barrel of a firearm. The first bracket portion 208 and the second bracket portion 210 are coupled together by bolts 216 and 218. In particular, bolt 216 secures the first bracket portion 208 to the second bracket portion 210 with nut 217 and bolt 218 secures the first bracket portion 208 to the second bracket portion 210 with nut 219. In addition, bolt 216 passes through a connection flange 207 to secure the range finder 200 to the first bracket 116. As illustrated in FIG. 2, the display housing 102 extends from a first side 203 of the circuit housing 310 and the flange 207 extends from a second side 205 that is opposite the first side 203. Moreover, although not shown, the second bracket is constructed in the same manner to couple the range finder 200 to the barrel 112 of the firearm 101 at another location.

Further illustrated in FIG. 2, is a first protective material 212 positioned adjacent a first inner surface 209 of the first bracket portion 208 and a second protective material 214 positioned adjacent a second inner surface 211 of the second bracket portion 210. The first and second protective material 212 and 214 are used to protect the barrel 112 of the firearm 101. Moreover, in one embodiment, the first and second protective material 212 and 214 come in different thickness to accommodate different barrel diameters. The first and second protective material 212 and 214 are made from material such as foam rubber and the like.

Figure 3:
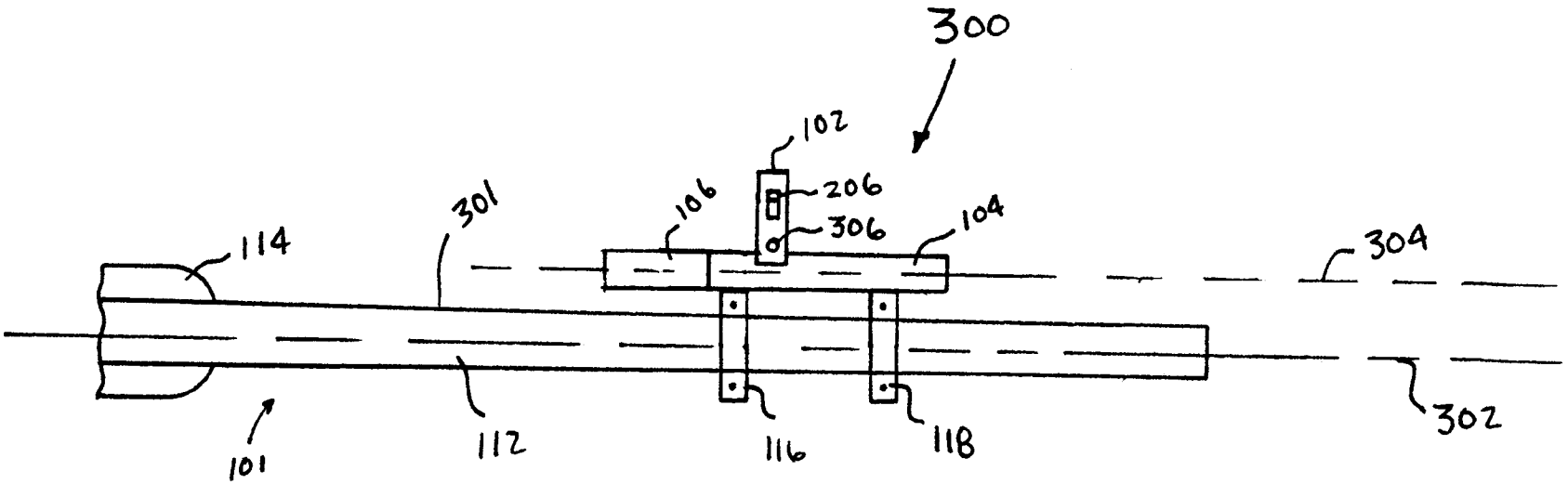
FIG. 3 is a top view of one embodiment of the present invention coupled to a barrel of a firearm.

Referring to FIG. 3, at top view of an embodiment of a range finder 300 of the present invention is illustrated. As illustrated, the range finder 300 is coupled so that it is positioned along a side 301 of the barrel 112 of the firearm 101. The positioning of the range finder 300 in this manner not only allows for a quick viewing of the distance by the hunter, it is also positioned so as to not interfere with the sight of the firearm. Embodiments, of the present invention can be mounted on either side of the barrel 112 of the firearm 101. Also illustrated in FIG. 3, is an on/off button 306 to turn on and off the range finder 300.

FIG. 3, further illustrates the barrel longitudinal axis 302 of the firearm. The barrel longitudinal axis 302 is the path of a bullet fired from the barrel 302. Further illustrated is a range finder longitudinal axis 304. The range finder longitudinal axis 304 is the path upon which the distance is determined. In the embodiments of the present invention, the range finder longitudinal axis 304 is adjusted to be generally parallel to the barrel longitudinal axis 302 so the distance of the bullet path is accurately determined by the range finder 300. Since some barrels 112 of firearms taper in diameter, a means of compensating to obtain parallel range finder and barrel longitudinal axis' 304 and 305 in needed.

Referring back to FIG. 2, one method of adjusting the position of the range finder 200 in relation to the barrel 112 to obtain parallel range finder and barrel longitudinal axis' is illustrated. The connection flange 207 has an adjusting aperture 220 with a lateral length 230 larger than the diameter of bolt 216 to allow the first bracket to be spaced at different distances from the range finder 200. In particular, bolt 216 passes through adjusting aperture 220 in coupling the first bracket to the range finder 200. Once a desired distance between the barrel of the firearm and the range finder 200 is achieved, nut 217 is tightened on bolt 216 thereby snugly coupling the first bracket 116 to the flange 207. Although not shown, the second bracket 118 is constructed in a similar manner to aid in aligning the range finder longitudinal axis 304 with the barrel longitudinal axis 302 of FIG. 3. In further another embodiment made for a specific barrel, the adjusting aperture 220 is placed in the flange 207 at a select position to obtain a desired distance between the first bracket 116 and the range finder 200.

Figure 4:
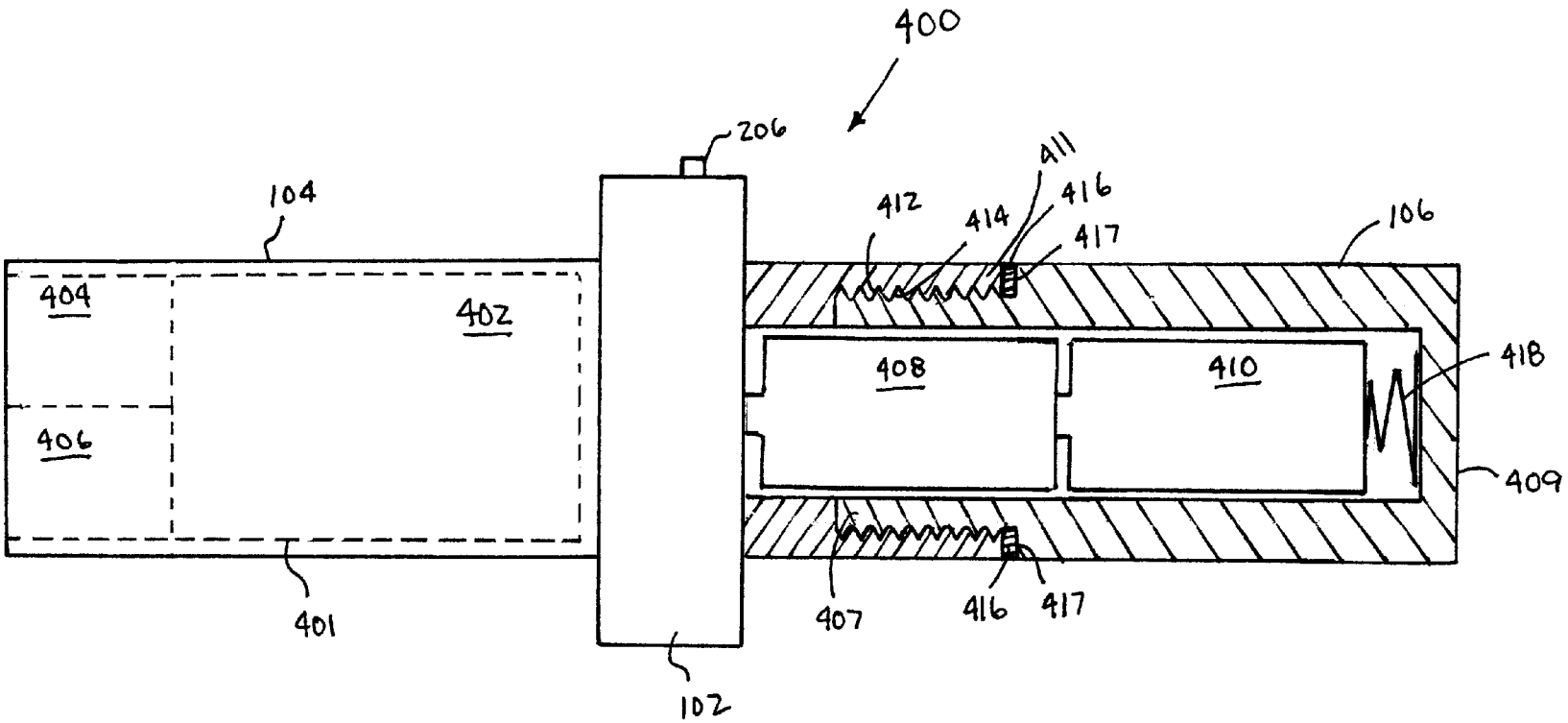
FIG. 4 is a side partial cut-out view of one embodiment of the present invention.

A side partial cross-sectional view of another range finder 400 embodiment of the present invention is illustrated in FIG. 4. The circuit housing 104 of the range finder 400 encases or houses the range finder circuit 401 that includes a range finder control circuit 402, a transmitter 404 and a receiver 406. The range finder control circuit 402 controls the range finding operations and is in electrical communication with the display 202, the transmitter 404 and the receiver 406. The transmitter 404 is used to transmit a laser signal and the receiver 406 is used to receive the signal after it has been reflected off a target (the object in which the distance to is to be determined). The range finder control circuit 402 then uses the transit time to determine the distance to the target. Once the distance has been determined, the range finder control 334, directs the display 202 to display the distance to the target. In the above-described embodiment, a range finder incorporating a light propagation time measuring method to determine the distance to an object is described. However, it will be understood in the art that other types of range finders could be used in the present invention such as the light-section method, the binocular sterosis method and the like, and the present invention is not limited to the light propagation time measuring method.

Also illustrated in FIG. 4, are power sources 408 and 410, which in this embodiment are batteries 408 and 410. The batteries 408 and 410 are housed in the weather cover 106 and are selectively coupled to supply power to the range finder control circuit 402, the transmitter 404, the receiver 406 and the display 202 when the weather cover is coupled to the circuit housing. A battery connection 418 is also shown. The weather cover 106 has a first end 407 and a second end 409. The second end 409 is enclosed. Moreover, the first end 407 of the weather cover 106 has external threads 412 that terminate in a shoulder 417. In addition, the circuit housing 104 has a first end 411 that has internal treads 414 that are adapted to threadably engage the external threads 412 of the weather cover 102. A seal 46 is positioned against the shoulder 417 so that when the external threads 412 of the weather cover 12 are threadably engaged with the internal threads 414 of the circuit housing 104 and tightened, the seal 417 is depressed against the shoulder 417 thereby creating a weatherproof seal. In addition, when the weather cover 106 is coupled to the circuit housing 104, the batteries 408 and 409 as well as other internal circuits are protected from weather like rain and snow. Moreover, when the weather cover 106 is not coupled to the circuit housing 104, a user has access to the batteries.

Figure 5:
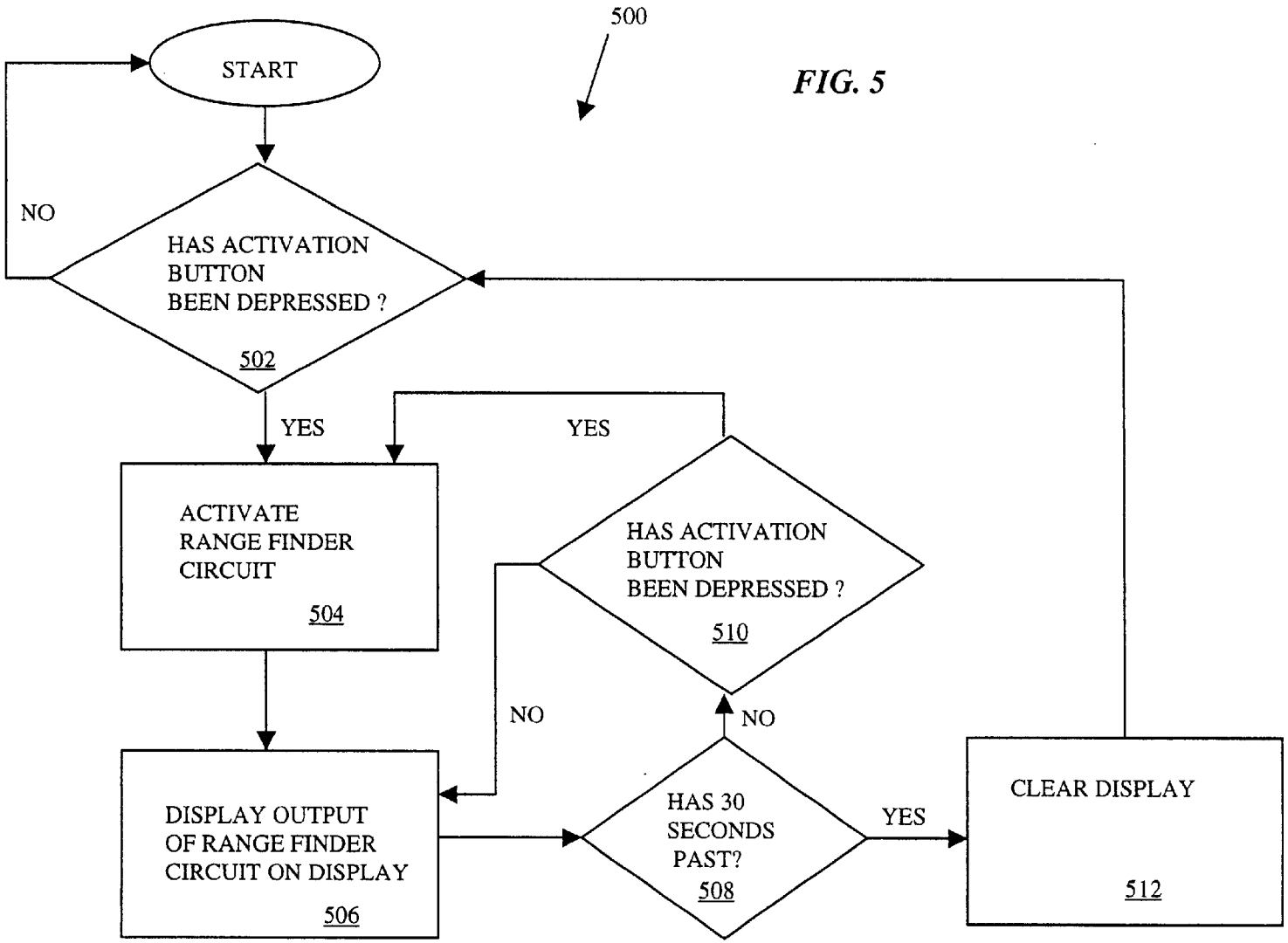
FIG. 5 is a flow chart illustrating the operation of one embodiment of the present invention.

A flow chart 500 illustrating one embodiment of the operation of the range finder control circuit 402 is illustrated in FIG. 5. Once, turned on, the range finder control circuit monitors the activation button 108 (502). Once, the activation button 108 is depressed, a range finder circuit 401 is activated to determine the distance to an object (504). The distance to the object is then displayed on display 202 (506). It is determined if 30 seconds has past since the distance was first displayed (508). If 30 seconds has not past, the activation button is monitored to see if it has been depressed (510). If it has not been depressed, the display continues to display the distance (506). If the activation button has been depressed, the range finder circuit is once again activated (504). If 30 seconds has past since the distance was first displayed, the display is cleared (512). The range finder control circuit 402 then monitors the activation button to see if it has been depressed (502). Although, this embodiment uses 30 seconds before clearing the display, other embodiments of the present invention use different selected times.

Figure 6:
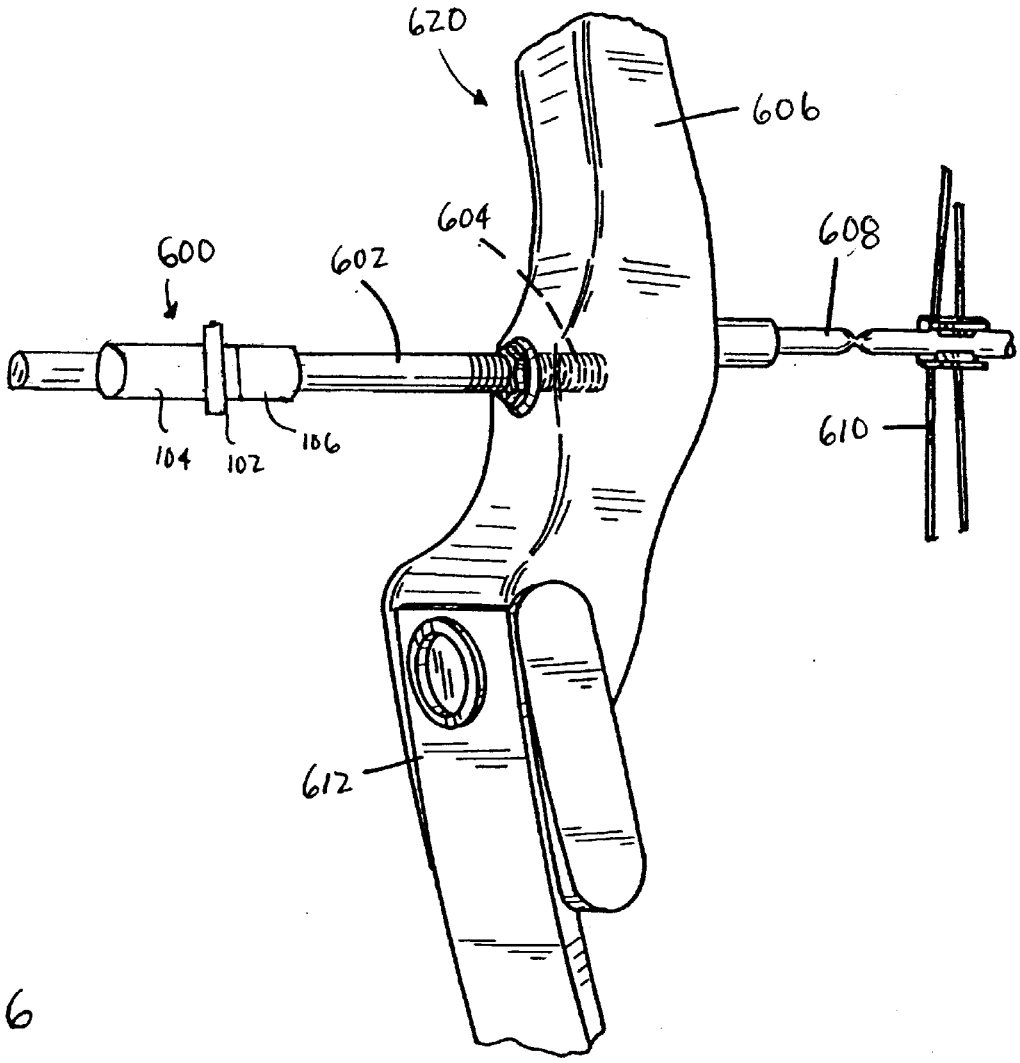
FIG. 6 is a side perspective view of one embodiment of the present invention coupled to a counterweight bar of a bow.

Another embodiment of a range finder 600 of present invention is illustrated in FIG. 6. In this embodiment, the range finder 600 is adapted to be mounted to a counterweight 602 of a bow 620. Since, the counterweight bar 602 is cylindrical in shape, like the barrel of the firearm, the method of attachment as illustrated in FIG. 2 is also applicable in this embodiment. The embodiment of FIG. 6, allows a bow hunter to use a range finder 600 in a fast and efficient manner without interfering with the hunt. The bow is illustrated as having a riser 606, a flexible bow element 612, a cable guard 608, bow string 610 and an internally threaded metal insert 604 that is adapted to receive external threads on the counterweight bar 602.

Figure 7:
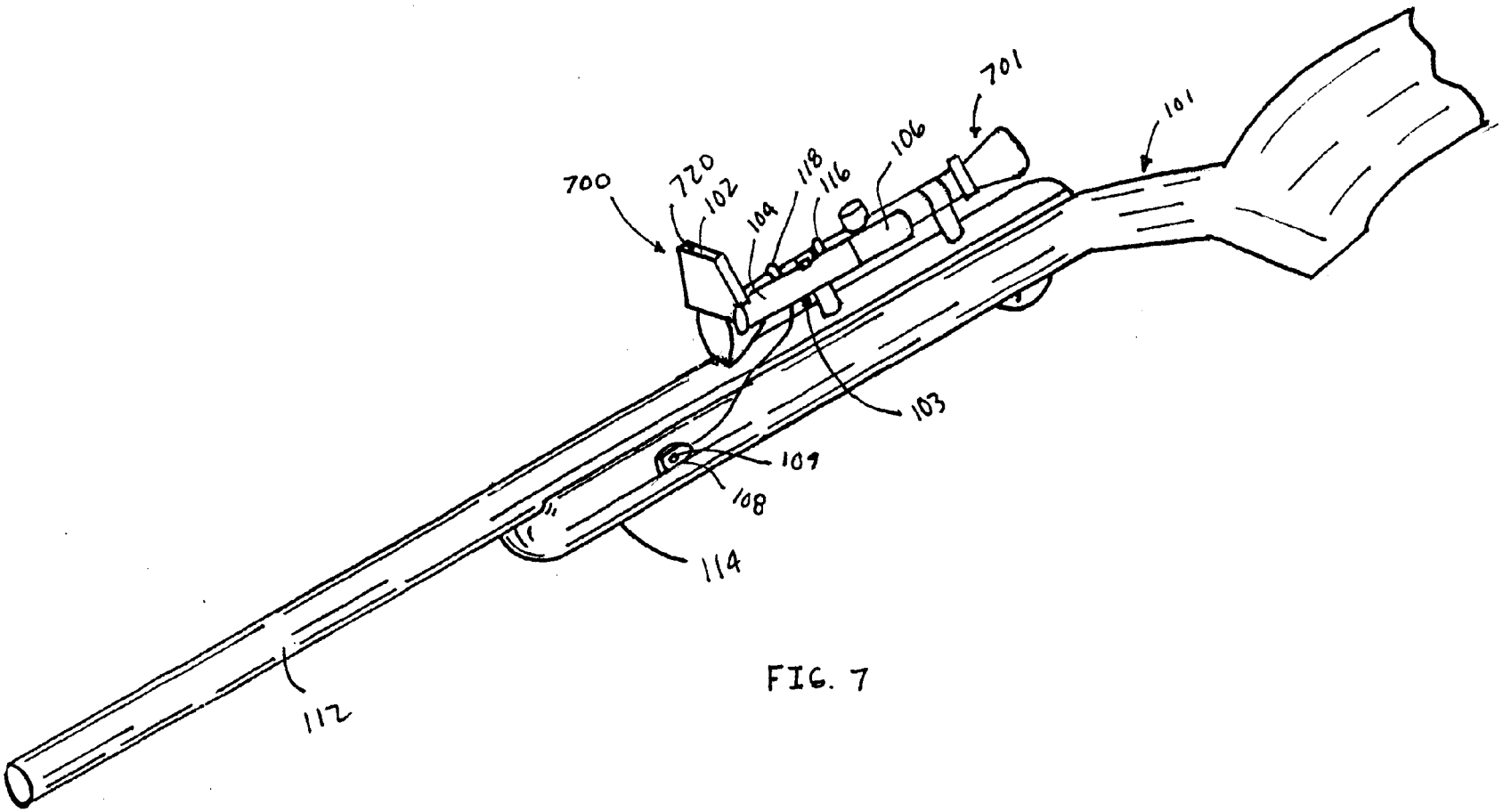
FIG. 7 is a side perspective view of another embodiment of the present invention coupled to a scope of a firearm.
Figure 8:
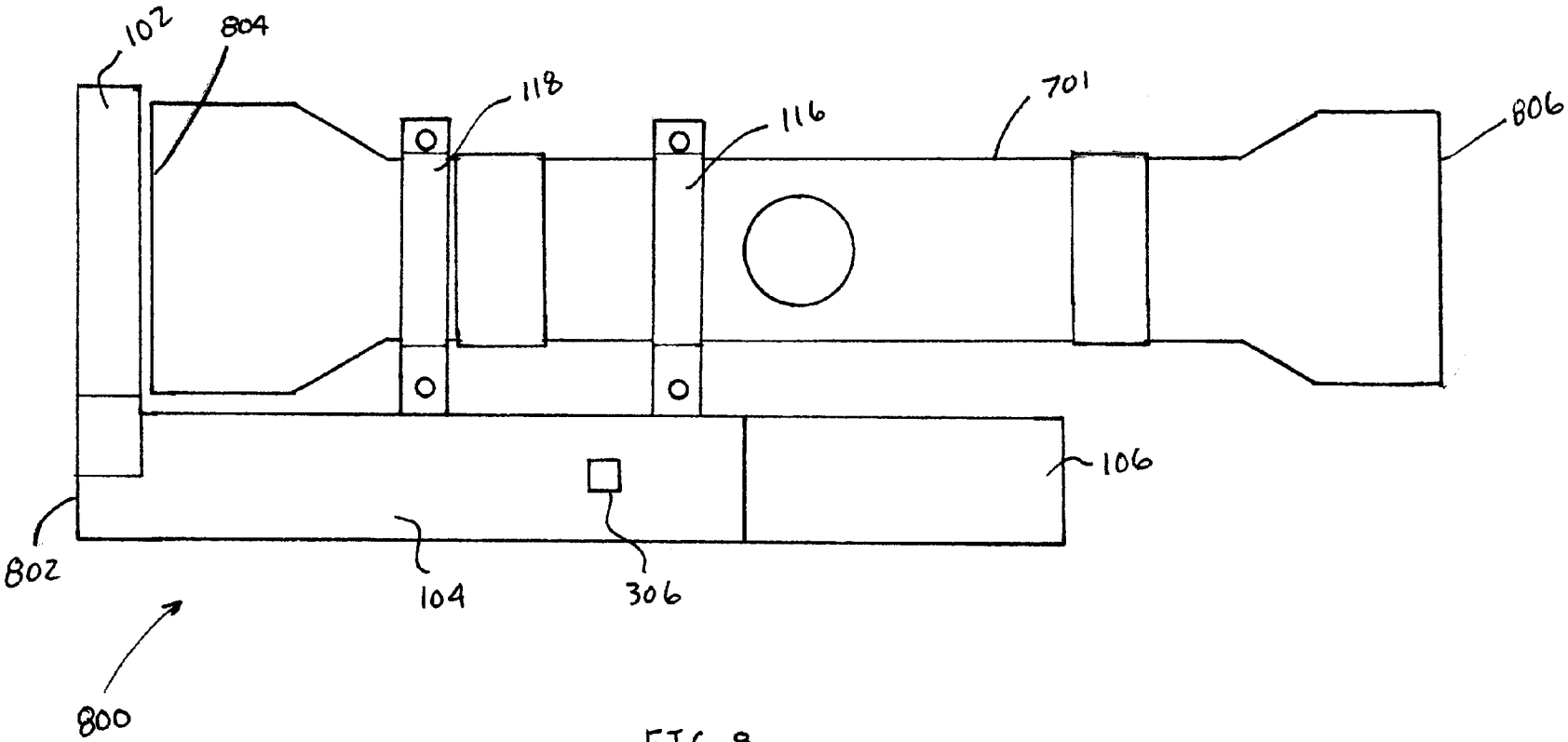
FIG. 8 is a top view of yet another embodiment of the present invention coupled to a scope of a firearm.

Referring to FIG. 7, yet another embodiment of the range finder 700 of the present invention is illustrated. As illustrated, this embodiment is adapted to be coupled to a scope 701 of a firearm 101. The range finder 700 is coupled to the scope with the first and second brackets 116 and 118 in the same manner the first and second brackets 116 and 118 couple the above-described range finder embodiments to the barrel 112 of firearm 101 and the counterweight bar 602 of bow 620. Also illustrated in FIG. 7 is remote control unit 108 and activation button 109 as is described in the embodiment of FIG. 1. The embodiment of FIG. 7, also includes a second activation button 720, wherein in this embodiment a user can either activate the range finder 700 by depressing activation button 109 or second activation button 720. Moreover, unlike the previous embodiments, in the embodiment of FIG. 7, the display housing 102 extends from a first end 802 of the circuit housing 104. This is further illustrated in the range finder 800 embodiment of FIG. 8. In this embodiment, the display housing 104 extends approximate a first end 804 of the scope 701. In fact, in this embodiment, the display housing 104 covers a portion of the first end 804 of the scope. FIG. 8 also illustrates the on/off button that is coupled to turn on and off the range finder 800 when depressed. Moreover, FIG. 8 further illustrates a second end 306 of the scope 701. The second end 806 of the scope 701 is the end in which a user looks through in sighting the scope on a target.

Figure 9:
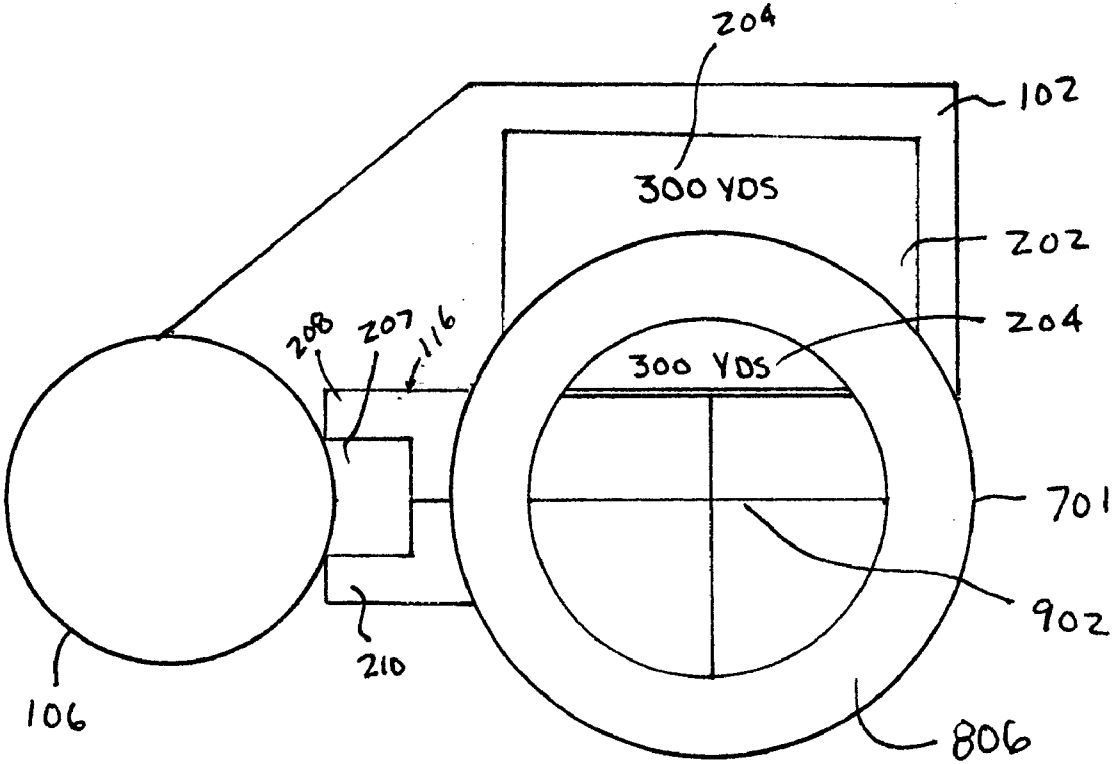
FIG. 9 is a rear view of yet another embodiment of the present invention coupled to a scope.

A rear view of one embodiment of a range finder 900 coupled to a scope 701 is illustrated in FIG. 9. As illustrated, the display 202 of this embodiment, uses indicia 204 to convey the distance the range finder 900 determines in two different locations. A first location of the display 202 with the indicia 204 is above the scope 701, so the user can determine distances without looking through the scope 701. A second location of the display 202 with the indicia 204 is in front of a portion of the scope so it can be viewed by looking through the second end of the scope 806. In this embodiment, the indicia 204, in the second display location, is optically adapted so the user can read the conveyed distance through the scope. Moreover, in this embodiment, the second location of the display 202 is positioned in front of an upper portion of the first end 804 of the scope 701 so the distance can be read above a sight 902 of the scope 701. Placing a portion of the display 202 in front of a portion of the first end 804 of the scope 701, allows the user the opportunity to view the distance and the sight 902 of the scope 701 at the same time thereby allowing the user the opportunity to read the distance without looking away from the sight 902.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A range finder circuit comprising:

a cylindrical main housing;

a range finder circuit contained in the main housing;

a display housing couple to a first side of the main housing;

a display received in the display housing, the display is in electrical communication with the range finding circuit; and one or brackets selectively coupled to a second side of the main housing, the second side of the main housing is opposite the first side of the main housing, wherein the one or more brackets are adapted to coupled the main housing to a portion of a hunting weapon.

2. The range finder of claim 1, wherein the main housing further comprises:

a circuit housing to contain the range finding circuit, and a weather cover to contain a power source, the weather cover is selectively coupled to the circuit housing, wherein when the weather cover is coupled to the circuit housing a weather proof seal is created.

3. The range finder of claim 1, wherein the portion of the hunting weapon is a counterweight of a bow.

4. The range finder of claim 1, wherein the range finder circuit further comprises:

a range finder control circuit to control range finding operations;

a transmitter to transmit a laser signal, the transmitter is electrically coupled to the range finder control circuit; and a receiver to receive the reflected laser signal, the receiver is electrically coupled to the range finder control circuit.

5. The range finder of claim 1, wherein the display housing is coupled to a mid portion of the main housing.

6. The range finder of claim 1, wherein the portion of the hunting weapon is a barrel of a firearm.

7. The range finder of claim 6, wherein the circuit housing is positioned approximate a side of the barrel of the firearm so it will not interfere with a sight of the firearm, further wherein a longitudinal axis of the range finder is parallel to a longitudinal axis of the barrel of the firearm.

8. The range finder of claim 1, further comprising:

a remote control unit to remotely operate the range finding circuit.

9. The range finder of claim 8, wherein the remote control unit is in wireless communication with the range finding circuit.

10. The range finder of claim 8, wherein the remote unit is electrically coupled to the range finder circuit by an attaching cord.

11. The range finder of claim 8, wherein the remote control is selectively coupled to a forearm of a firearm.

12. A range finder comprising:

a circuit housing having a first side and a second side opposite the first side;

a range finder circuit to perform range finding functions contained in the circuit housing;

a display housing coupled to extend from the first side of the circuit housing;

a display encased in the display housing to display distances, the display in electrical communication with the range finder control circuit;

a weather cover having a first end adapted to selectively couple to a first end of the circuit housing to form a weatherproof seal and a second enclosed end;

a power supply selectively housed in the weather cover, wherein when the power supply is housed in the weather cover and the weather cover is coupled to the circuit housing the power supply is electrically coupled to supply power to the range finder circuit and the display; and one or more brackets adapted to couple the second side of the circuit housing to a weapon.

13. The range finder of claim 12, wherein each of the brackets further comprises:

a first bracket portion having an first inner surface adapted to fit around a first portion of the weapon; and a second bracket portion having a second inner surface adapted to fit around a second portion of the weapon, wherein the first and second portion of the weapon is positioned between the first and second bracket portion to coupled the first and second portions to the weapon.

14. The range finder of claim 13, wherein the first and second portions of the weapon are first and second portions of a barrel of a firearm.

15. The range finder of claim 13, wherein the first and second portions of the weapon are first and second portion of a counterweight bar of a bow.

16. The range finder of claim 13, further comprising:

a first protection material portion positioned adjacent the first inner surface of the first bracket portion to protect the first portion of the weapon; and a second protection material portion positioned between the second inner surface of the second bracket portion to the first portion of the weapon.

17. The range finder circuit of claim 16, wherein the first and second protection material have a selected thickness to accommodate the size of the first and second portions of the weapon.

18. The range finder of claim 13, further comprising:

a flange extending from the second side of the circuit housing for each bracket, each flange having an adjusting aperture; and a bolt for each flange, each flange is coupled between a portion of an associated first and second bracket portion by an associated bolt that is received in the adjusting aperture of the flange.

19. The range finder circuit of claim 18, wherein each adjusting aperture has a select lateral length that is greater than a diameter of an associated bolt to allow the distance between the first and second brackets and the circuit housing to be adjusted.

20. The range finder of claim 19, wherein the first and second portions of the weapon are first and second portions of a barrel of a firearm.

21. The range finder of claim 20, wherein a longitudinal axis of the range finder and weather cover can be adjusted to be parallel with a longitudinal axis of the barrel of the firearm by the positioning of the bolt in an adjusting aperture in an associated flange.

22. A range finder comprising:

a circuit housing generally cylindrical in shape having first end with internal threads;

a range finder circuit to perform range finding functions contained in the circuit housing;

a display housing coupled to extend from a select side of the circuit housing;

a display encased in the display housing to display distances, the display electrically coupled to the range finder circuit to receive distances signals;

a weather cover cylindrical in shape having a first end with external threads that terminate in a shoulder, the external threads are adapted to threadably engage the internal threads of the circuit housing, the weather cover further having a second enclosed end; and a power supply selectively housed in the weather cover, wherein when the power supply is housed in the weather cover and the weather cover is threadably coupled to the circuit housing the power supply is electrically coupled to the range finder circuit and the display.

23. The range finder of claim 22, further comprising:

a seal positioned adjacent the shoulder of the weather cover, wherein the seal is compressed to form the weatherproof seal when the external threads of the weather cover are fully engaged with the internal threads of the circuit housing.

24. The range finder of claim 22, further comprising a coupling means to selectively couple the range finder to a barrel of a firearm.

25. The range finder of claim 22, further comprising a coupling means to selectively couple the range finder to a counterweight bar of a bow.

26. The range finder of claim 22, further comprising a coupling means to selectively couple the range finder to a firearm scope.

27. The range finder of claim 22, further comprising:

a remote control unit in electrical communication with the range finder circuit to selectively activate the range finder.

28. The range finder circuit of claim 22, further comprising:

one or more flanges extending from a second side of the circuit housing; and a bracket for each flange to couple an associated flange to a hunting object.

29. The range finder of claim 28, wherein the at least one bracket further comprises:

a first bracket portion adapted to fit around a first portion of the hunting object; and a second bracket portion adapted to fit around a second portion of the hunting object, wherein the first and second portion of the hunting object is coupled between the first and second bracket portions.

30. The range finder of claim 29, wherein the associated flange is coupled between a portion of the first and second bracket portions to coupled the first and second bracket portions to the circuit housing with a bolt.

31. The range finder of claim 29, wherein the hunting object is selected from a group consisting of a barrel of a firearm and a counterweight bar of a bow.

32. The range finder of claim 31, wherein the select side the display housing extends from the circuit housing is a first side that is opposite the second side.

33. The range finder of claim 29, wherein the hunting object is a scope.

34. The range finder of claim 33, wherein the select side the display housing extends from the circuit housing is the second side of the circuit housing.

35. The range finder of claim 34, further wherein the display housing extends from a second end of the circuit housing and is positioned approximate a portion of a first end of the scope when the range finder is attached to the scope so that indicia on the display can be seen by looking through a second end of the scope.

36. A range finder comprising:

a main housing;

a range finder circuit contained in the main housing to determine distances to objects;

a display housing extending from the main housing;

a display encased in the display housing, the display is electrically coupled to the range finder circuit to display one or more indicia representative of distances determined by the range finder circuit; and one or more brackets coupled to the range finder housing, the one or more brackets adapted to couple the range finder housing to a scope.

37. The range finder of claim 36, wherein the display is capable of producing at least two indicia that convey distances at different locations of the display.

38. The range finder of claim 37, further wherein a portion of the display is positioned approximate a portion of a first end of the scope so that one of the indicia is visible when looking through a second end of the scope.

39. The range finder of claim 37, further wherein at least one of the indicia can be seen without looking through the scope.

40. The range finder of claim 36, further comprising:

a remote control unit in electrical communication with the range finder control circuit to selectively activate the range finder.

41. The range finder of claim 40, wherein the remote control is selectively coupled to a forearm of the firearm.

42. The range finder of claim 36, wherein the main housing further comprises;

a circuit housing having a first side and a second side opposite the first side, the range finder circuit is housed in the circuit housing, the display housing extends from the second side of the circuit housing adjacent a first end of the circuit housing;

a weather cover selectively coupled to a second end of the circuit housing; and a power source housed in the weather cover, wherein the power source is electrically coupled to supply power to the range finder circuits and the display when the weather cover is coupled to the circuit housing.

43. The range finder of claim 42, wherein the first end of the circuit housing is cylindrical in shape and a first end of the weather cover that is selectively coupled to the circuit housing is also cylindrical in shape.

44. The range finder of claim 43, further comprising:

the first end of the circuit housing having internal threads; and the first end of the weather cover having external threads terminating in a shoulder, the external threads are adapted to threadably engage the internal threads of the circuit housing.

45. The range finder of claim 44, further comprising:

a seal positioned adjacent the shoulder of the weather cover, wherein the seal is compressed to form the weatherproof seal when the external threads of the weather cover are fully engaged with the internal threads of the circuit housing.

46. The range finder of claim 42, further comprising:

a flange extending from the second side of the circuit housing for each of the one or more brackets to couple each of the one or more brackets to the circuit housing.

47. The range finder of claim 46, wherein each of the one or more brackets further comprises:

a first bracket portion adapted to fit around a first portion of the scope; and a second bracket portion adapted to fit around a second portion of the scope, wherein the first and second portion of the scope is coupled between the first and second bracket portions, further an associated flange is coupled between a portion of the first and second bracket portions to coupled the first and second bracket portions to the circuit housing.

48. The range finder of claim 47, wherein the associated flange is coupled between a portion of the first and second bracket portions to coupled the first and second bracket portions to the circuit housing with a bolt.

* * * * *

UNITED STATES PATENT AND TRADEMARK OFFICE

CERTIFICATE OF CORRECTION

PATENT NO. : 6,615,531 B1
DATED : September 9, 2003
INVENTOR(S) : Holmberg

It is certified that error appears in the above-identified patent and that said Letters Patent is hereby corrected as shown below:

Column 3,
Line 16, please replace “prefer” with -- preferred --
Line 17, please delete “red”.

Signed and Sealed this

Fourth Day of January, 2005

JON W. DUDAS
*Director of the United States Patent and Trademark Office*